US005988124A

United States Patent [19]

Duesmann

[11] Patent Number: 5,988,124

[45] Date of Patent: Nov. 23, 1999

[54] ELECTROMAGNETICALLY ACTUATED CYLINDER VALVE HAVING PNEUMATIC RESETTING SPRINGS

[75] Inventor: Markus Duesmann, Stolberg, Germany

[73] Assignee: FEV Motorentechnik GmbH & Co. Kommanditgesellschaft, Aachen, Germany

[21] Appl. No.: 09/267,786

[22] Filed: Mar. 15, 1999

[30] Foreign Application Priority Data

Mar. 14, 1998 [DE] Germany ..... 298 04 549 U
Sep. 9, 1998 [DE] Germany ..... 198 41 124

[51] Int. Cl.[6] ..... F01L 9/04

[52] U.S. Cl. ..... 123/90.11; 123/90.14; 335/240

[58] Field of Search ..... 335/240, 266, 335/268; 123/90.11–90.14

[56] References Cited

U.S. PATENT DOCUMENTS 5,611,303 3/1997 Izuo ..... 123/90.11

*Primary Examiner*—Lincoln Donovan
*Assistant Examiner*—Raymond Barrera
*Attorney, Agent, or Firm*—Venable; Gabor J. Kelemen

[57] ABSTRACT

An apparatus for reciprocating an engine valve between open and closed positions in an internal-combustion engine includes an electromagnetic actuator having first and second mutually spaced electromagnets for generating electromagnetic forces; and an armature disposed between the first and second electromagnets and movable in response to the electromagnetic forces. The armature is operatively coupled to the engine valve to cause it to reciprocate between its open and closed positions. First and second gas springs are coupled to the armature for opposing the electromagnetic forces generated by the first and second electromagnets, respectively. A pressurized gas source supplies the first and second gas springs with pressure and a control arrangement varies the pressure in the first and second gas springs. A positioning spring is coupled to the engine valve for moving the engine valve into its closed position when the first and second gas springs are in a depressurized state.

1 Claim, 2 Drawing Sheets

ELECTROMAGNETICALLY ACTUATED CYLINDER VALVE HAVING PNEUMATIC RESETTING SPRINGS

CROSS REFERENCE TO RELATED APPLICATION

This application claims the priority of German Application Nos. 298 04 549.4 filed Mar. 14, 1998 and 198 41 124.3 filed Sep. 9, 1998, which are incorporated herein by reference.

BACKGROUND OF THE INVENTION

In internal-combustion engines of more recent design the cylinder valves have been operated by electromagnetic actuators instead of the classic cam shaft/push rod assembly which have long characterized valve control in internal-combustion engines. Such an electromagnetic actuator generally includes two spaced electromagnets between which an armature may be reciprocated by electromagnetic forces generated by the electromagnets which are supplied with current from a control device. The electromagnetic force exerted on the armature is counteracted by the force of resetting springs. The armature is coupled with the cylinder valve (engine valve) to cause motion thereof as the armature executes its reciprocating motion. Such an electromagnetic actuator is disclosed, for example, in U.S. Pat. No. 4,455,543.

Operating a cylinder valve by means of an electromagnetic actuator permits a freely variable control by an electronic control device as concerns the opening moment and the open period of the valve to correspond to momentary load requirements. In the design of the electromagnetic actuator, however, the spring/mass system composed of the armature, the cylinder valve and the resetting springs has to be considered as being a fixed predetermined magnitude as concerns the oscillation characteristics of the system.

Heretofore mechanical springs such as coil springs have been used as resetting springs which basically perform in a satisfactory manner.

Engines having electromagnetically controlled cylinder valves of the above type, however, need valve-accommodating pockets in the piston crown, since after a de-energization of the electromagnets, the cylinder valve assumes its position of rest in a half-open position because of the force equilibrium of the mechanical springs. Such a free valve motion ensures that the valves do not impact against the piston and thus cannot be damaged or destroyed. Such a free valve motion is furthermore needed to be able to start the oscillating motion of the cylinder valves upon engine start even if the associated piston is in its upper dead center position. The valve pockets in the piston crown, however, very significantly break up the evenness of the combustion chamber and therefore make difficult to optimally configure the combustion chamber in non-homogeneously driven, directly-injected Otto engines.

SUMMARY OF THE INVENTION

It is an object of the invention to provide an improved valve arrangement of the above-outlined type which is further ameliorated as concerns its adaptation to operational conditions.

This object and others to become apparent as the specification progresses, are accomplished by the invention, according to which, briefly stated, the apparatus for reciprocating an engine valve between open and closed positions in an internal-combustion engine includes an electromagnetic actuator having first and second mutually spaced electromagnets for generating electromagnetic forces; and an armature disposed between the first and second electromagnets and movable in response to the electromagnetic forces. The armature is operatively coupled to the engine valve to cause it to reciprocate between its open and closed positions. First and second gas springs are coupled to the armature for opposing the electromagnetic forces generated by the first and second electromagnets, respectively. A pressurized gas source supplies the first and second gas springs with pressure and a control arrangement varies the pressure in the first and second gas springs. A positioning spring is coupled to the engine valve for moving the engine valve into its closed position when the first and second gas springs are in a depressurized state.

The use of pneumatic springs which, by means of a suitable pressure control, are variable in their force and spring constant, is advantageous because with the aid of the engine control device which is present in any event, the spring constants and thus the oscillation characteristics of the oscillating system formed by the armature and the cylinder valve may be adapted to the momentary load requirements of the engine. Thus, it is feasible, starting from a minimum resetting force predetermined by a corresponding pressure, to adapt the resetting force and the oscillation characteristics to the momentary engine operation by a corresponding increase or decrease of the pressure applied to the pneumatic springs. An increase of the resetting force is, for example, expedient during engine run at high rpm's in order to effect the necessary high acceleration of the armature and the cylinder valve needed for the short operating periods. In case of such pneumatic springs too, upon de-energization of the electromagnets the armature assumes a mid position between the two pole faces of the electromagnets so that the cylinder valve extends into the combustion chamber in a half-open position. Due to leakage losses or because the associated control valves are fully open upon de-energization, during standstill the cylinder valve may even move into the fully open position and thus, dependent on the position of the piston in the cylinder, the cylinder valve may lie on the piston crown. By providing a mechanical positioning spring, it is feasible, independently from the momentary position of the piston, to move all the cylinder valves into the closed position by depressurizing the pneumatic resetting springs. It is sufficient if the individual positioning springs are so designed that they are capable of overcoming the inner friction of the actuator and the cylinder valve guide. The spring force of the individual positioning springs required for this purpose is negligibly small compared to the forces to be applied by the pneumatic springs during operation. If required, however, it is feasible to reduce, by the suitable amount, the spring force of the pneumatic spring operating parallel to the additional spring.

DESCRIPTION OF THE PREFERRED EMBODIMENT

Figure 1:
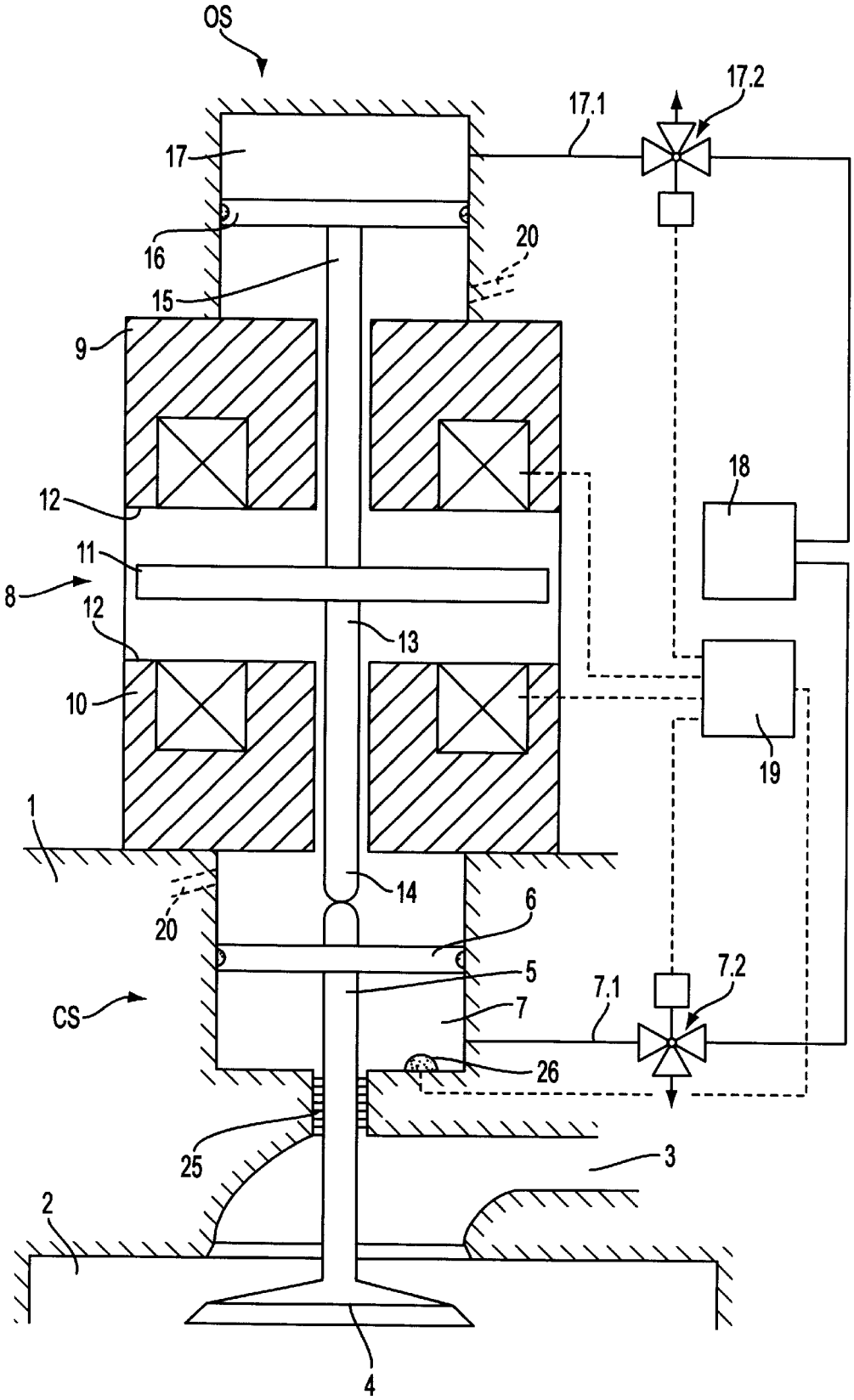
FIG. 1 is a schematic sectional elevational view of a preferred embodiment of the invention, including externally located pneumatic springs and showing the cylinder valve in a partially open position.

FIG. 1 shows a portion of a cylinder head 1 of an internal-combustion engine in the port region of a cylinder 2. The port 3 which merges into the cylinder 2 and which may be an intake port or an exhaust port may be opened and closed by an engine valve 4 in accordance with the operational cycle of the engine. The valve 4 is provided at the free end of its stem 5 with a piston 6 which is guided in a cavity formed in the cylinder head 1 and constituting a cylinder 7.

The engine valve 4 is coupled with an electromagnetic actuator 8 essentially composed of a closing magnet 9 and an opening magnet 10 between which an armature 11 may reciprocate. The armature 11 shown in FIG. 1 is depicted in a de-energized state of the electromagnets 9 and 10 and is thus situated in the mid position between the pole faces 12 of the two spaced magnets 9, 10.

The armature 11 is connected with a guide rod 13 which, in turn, is cooperating at its free end 14 with the stem 5 of the engine valve 4 and is, at its other end 15, provided with a piston 16 which is guided in a cylinder 17. The cylinders 7 and 17 are coupled by respective pressure lines 7.1 and 17.1 with a pressure supply 18. In both pressure lines 7.1 and 17.1 respective regulatable three-way valves 7.2 and 17.2 are arranged, whereby, dependent upon the valve position, the pressure in the cylinders 7 and 17 may be increased or reduced. The setting drives for the valves 7.2 and 17.2 are coupled with a control device 19 and form, together with the latter, an integral part of the engine control system.

The control device 19 also supplies the electromagnets 9 and 10 with current dependent upon operational conditions. The cylinder 7, together with the piston 6 and the cylinder 17, together with the piston 16 constitute respective pneumatic springs which serve as resetting springs for the electromagnetic system. Thus, the pneumatic spring formed by the piston-and-cylinder unit 6, 7 constitutes a closing spring CS, whereas the piston-and-cylinder unit 16, 17 constitutes an opening spring OS for the engine valve 4.

If, for example, both pneumatic springs CS and OS are provided with the same pressure, the armature 11, in the de-energized state of the electromagnets 9 and 10, assumes its illustrated mid position. If upon energization of the closing magnet 9 the armature 11 is moved out of its mid position and is caused to engage the pole face 12 of the closing magnet 9, the pressure in the cylinder 17 of the opening spring OS increases. If subsequently the closing magnet 9 is de-energized, the opening spring OS accelerates the armature 11 in the direction of the opening magnet 10, and, as the armature moves past its mid position, the gas pressure in the cylinder 7 of the closing spring CS accordingly increases as the armature 11 approaches the pole face 12 of the opening magnet 10. As the armature passes beyond its mid position in the course of such a travel, the opening magnet 10 is energized so that the magnetic field which builds up in response, captures the armature 11 and causes it to arrive into engagement at the pole face 12 of the opening magnet 10 and, accordingly, the engine valve 4 is held in the open position as determined by the period of energized state as set by the control device 19. If the engine valve 4 is to be closed, then in a reverse order the opening magnet 10 is de-energized and, accordingly, the closing magnet 9 is energized. The reciprocating motion of the armature 11 and the engine valve 4 resulting from such an energization occurs according to the cycle inputted into the control device 19 as a function of the engine rpm. The portions of the cylinders 7 and 17 bordered by the respective pistons 6 and 16 and oriented towards the electromagnets 9 and 10 have vents 20 to avoid an adverse effect on the armature movement in case an encapsulated magnetic system is used.

In order to be able to determine the position of the armature 11 relative to the respective pole faces 12 of the electromagnets 9 or 10, at least in one of the pressure chambers, for example, in the cylinder 7, a pressure sensor 26 is arranged whose signal conductor is connected with the control device 19. This arrangement makes it possible to obtain information by means of the pressure or by a time-dependent change of the pressure concerning the position of the armature 11 as it approaches the pole face 12 of the capturing electromagnet. Such a signal is taken into consideration in the control of the energization of the capturing electromagnet. It is also feasible to provide a similar pressure sensor in the cylinder 17 so that based on the superposition of the two signals (increase of the pressure in one cylinder and a corresponding drop in the pressure in the other cylinder) the reliability of the information concerning the position of the armature may be increased.

It is a further advantage of such pressure sensors that the pressure detected for the two cylinders 7 and 17 may also be used for the control of the valves 7.2 and 17.2 if, for example, in case of an increasing rpm, the pressure has to be increased and upon an rpm drop the pressure has to be reduced.

When the engine is turned off, the setting drives for the valves 7.2 and 17.2 are also deactivated and thus ideally, both pneumatic springs OS and CS are, by means of the residual gas pressure in the system, pressurized with the same pressure and therefore the armature 11 assumes its mid position shown in FIG. 1. If the control system is designed such that the pneumatic springs are entirely depressurized during standstill of the engine, the engine valve 4 may drop into the fully open position and may contact the piston crown, dependent on the position of the armature.

Figure 2:
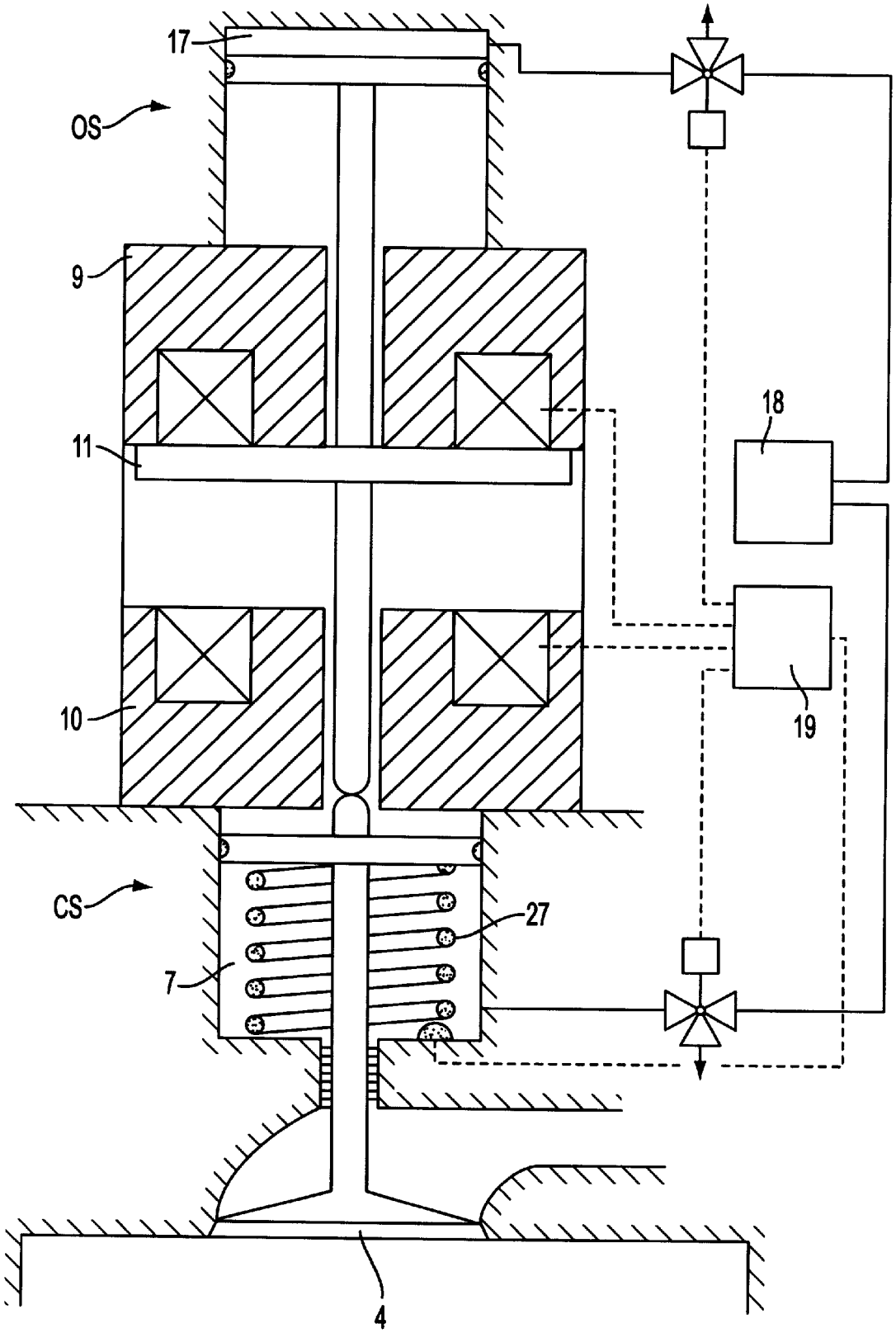
FIG. 2 is a sectional elevational view similar to FIG. 1, including a mechanical positioning spring.

If, however, as shown in FIG. 2, a mechanical positioning spring 27 is provided which urges the engine valve 4 into the closed position then, during standstill of the engine and upon simultaneous depressurizing of the pneumatic springs OS and CS, the engine valve 4, under the force of the positioning spring 27, is moved into its closed position and, at the same time, the armature 11 is moved into contact with the pole face 12 of the closing magnet 9. When the engine is started based on a suitable engine start control scheme, each engine valve may be brought from its respective closed position into a position required for the associated engine cycle, since a motion of the engine valve in the initial starting phase may occur directly by means of a corresponding alternating pressurization of the pneumatic springs. Thus, at least for the first revolutions of the engine in this phase, the engine valves may be moved in a positive manner in addition to the electromagnetic force of the opening and closing magnets of the electromagnetic actuator.

The mechanical positioning spring 27 is shown schematically in FIG. 2 as a coil compression spring. It is, however, also feasible to use leaf springs or other suitably shaped bending springs, even tension springs, dependent on the structure of the actuator and the coupling between the actuator and the engine valve.

It will be understood that the above description of the present invention is susceptible to various modifications, changes and adaptations, and the same are intended to be comprehended within the meaning and range of equivalents of the appended claims.

What is claimed is:

1. An apparatus for reciprocating an engine valve between open and closed positions in an internal-combustion engine, comprising (a) an electromagnetic actuator having (1) first and second mutually spaced electromagnets for generating electromagnetic forces; and (2) an armature disposed between said first and second electromagnets and movable in response to the electromagnetic forces; said armature being operatively coupled to the engine valve to cause reciprocating motions thereof between said open and closed positions;

(b) first and second gas springs coupled to said armature for opposing the electromagnetic forces generated by said first and second electromagnets, respectively;

(c) a pressurized gas source for supplying said first and second gas springs with pressure;

(d) control means for varying the pressure in said first and second gas springs; and (e) a positioning spring coupled to the engine valve for moving the engine valve into the closed position when said first and second gas springs are in a depressurized state.

* * * * *